US009175527B2

(12) United States Patent
McIntosh et al.

(10) Patent No.: US 9,175,527 B2
(45) Date of Patent: Nov. 3, 2015

(54) APPARATUS FOR HANDLING TUBULARS

(75) Inventors: Richard McIntosh, Lafayette, LA (US); Toby Scott Baudoin, Rayne, LA (US)

(73) Assignee: 2M-TEK, Inc., Scott, LA (US)

( * ) Notice: Subject to any disclaimer, the term of this patent is extended or adjusted under 35 U.S.C. 154(b) by 0 days.

(21) Appl. No.: 13/636,505

(22) PCT Filed: Mar. 22, 2011

(86) PCT No.: PCT/US2011/000519

§ 371 (c)(1),
(2), (4) Date: Sep. 21, 2012

(87) PCT Pub. No.: WO2011/119213

PCT Pub. Date: Sep. 29, 2011

(65) Prior Publication Data

US 2013/0011221 A1 Jan. 10, 2013

Related U.S. Application Data

(60) Provisional application No. 61/340,894, filed on Mar. 24, 2010.

(51) Int. Cl.
*E21B 19/06* (2006.01)

(52) U.S. Cl.
CPC ..... *E21B 19/06* (2013.01)

(58) Field of Classification Search
CPC ..... E21B 19/06; E21B 19/07
USPC ..... 294/194, 198, 201, 102.2, 902, 90
See application file for complete search history.

(56) References Cited

U.S. PATENT DOCUMENTS

| | | | | | |
|---|---|---|---|---|---|
| 1,502,628 | A | * | 7/1924 | Hanna | 175/423 |
| 2,392,462 | A | * | 1/1946 | Coe | 294/90 |
| 4,441,749 | A | * | 4/1984 | Blaschke et al. | 294/194 |
| 4,647,099 | A | * | 3/1987 | Berry et al. | 294/103.1 |
| 5,221,099 | A | * | 6/1993 | Jansch | 279/151 |
| 5,437,489 | A | | 8/1995 | Sanders et al. | |
| 5,451,084 | A | * | 9/1995 | Jansch | 166/77.53 |
| 5,537,900 | A | | 7/1996 | Schaar | |
| 5,669,653 | A | | 9/1997 | Penisson | |
| 5,671,961 | A | | 9/1997 | Buck | |
| 5,702,139 | A | | 12/1997 | Buck | |
| 5,778,742 | A | | 7/1998 | Stuart | |
| 5,791,206 | A | | 8/1998 | Daigle et al. | |
| 5,842,390 | A | | 12/1998 | Bouligny et al. | |
| 5,971,086 | A | * | 10/1999 | Bee et al. | 175/423 |

(Continued)

FOREIGN PATENT DOCUMENTS

| | | | |
|---|---|---|---|
| MX | PA05004572 | | 5/2006 |
| MX | 2011007928 | A | 12/2011 |
| WO | 2014183929 | A1 | 11/2014 |

*Primary Examiner* — Dean Kramer

(74) *Attorney, Agent, or Firm* — Andrews Kurth LLP

(57) ABSTRACT

A method and apparatus for facilitating running or pulling tubulars from a well bore whereby the manual operations or functions normally performed by a human are undertaken by the THD and may including remote control or manipulation. The THD comprises an elevator assembly (THD) with a main body consisting of upper and lower plates, a scissor assembly and multiple sized die blocks to conform to the tubular diameter. The THD can be used as a transfer elevator to position the tubular for engagement by the make-up assembly, can be outfitted to perform as a safety clamp or restraining device and also configured as a tubular stabbing arm as required by the operation.

17 Claims, 6 Drawing Sheets

(56) References Cited

U.S. PATENT DOCUMENTS

| | | | | |
|---|---|---|---|---|
| 5,996,444 | A | 12/1999 | Pearce et al. | |
| 6,012,360 | A | 1/2000 | Concha | |
| 6,116,118 | A | 9/2000 | Wesch, Jr. | |
| 6,138,529 | A | 10/2000 | Pietras | |
| 6,212,976 | B1 | 4/2001 | Stogner | |
| 6,227,587 | B1 * | 5/2001 | Terral | 294/102.2 |
| 6,279,662 | B1 * | 8/2001 | Sonnier | 166/380 |
| 6,431,029 | B1 | 8/2002 | Hawkins, III | |
| 6,938,520 | B1 | 9/2005 | Stuart | |
| 6,948,904 | B2 | 9/2005 | Bunn et al. | |
| 7,055,594 | B1 | 6/2006 | Springett et al. | |
| 7,090,254 | B1 | 8/2006 | Pietras et al. | |
| 7,121,166 | B2 | 10/2006 | Drzewiecki | |
| 7,140,445 | B2 | 11/2006 | Shahin et al. | |
| 7,866,721 | B2 | 1/2011 | Hollin | |
| 7,958,787 | B2 | 6/2011 | Hunter | |
| 8,011,426 | B1 | 9/2011 | Orgeron | |
| 8,079,627 | B2 | 12/2011 | Lutzhoff et al. | |
| 8,215,687 | B2 | 7/2012 | Pietras et al. | |
| 8,267,450 | B2 * | 9/2012 | Aarhus et al. | 294/194 |
| 8,281,877 | B2 | 10/2012 | Shahin et al. | |
| 8,419,097 | B2 | 4/2013 | Lunde | |
| 8,474,806 | B2 | 7/2013 | Orgeron | |
| 8,496,238 | B1 | 7/2013 | Orgeron | |
| 8,544,914 | B2 | 10/2013 | Hessels et al. | |
| 2005/0166715 | A1 | 8/2005 | Rogers | |
| 2006/0000601 | A1 * | 1/2006 | Pietras | 166/77.53 |
| 2006/0011350 | A1 * | 1/2006 | Wiggins et al. | 166/379 |
| 2007/0095524 | A1 * | 5/2007 | Lesko | 166/77.1 |
| 2007/0228753 | A1 | 10/2007 | Dugal et al. | |
| 2008/0060850 | A1 | 3/2008 | Stanton et al. | |
| 2008/0136203 | A1 * | 6/2008 | Krijnen et al. | 294/91 |
| 2009/0252589 | A1 * | 10/2009 | Sonneveld et al. | 414/800 |
| 2010/0289285 | A1 | 11/2010 | Stoldt et al. | |

* cited by examiner

APPARATUS FOR HANDLING TUBULARS

This application claims priority from U.S. Provisional application Ser. No. 61/340,894 ("the '894 application") filed Mar. 24, 2010. The '894 application is incorporated herein by reference.

BACKGROUND OF THE INVENTION

The present invention relates to a method and apparatus for facilitating the connection of tubulars used in the oil and gas exploration and extraction industries. More specifically, the invention relates to an apparatus for facilitating the handling of tubulars into or out of a well bore.

In the construction of oil or gas wells it is usually necessary to line the well bore with a string of steel pipes commonly known as tubular or tubing or generically as oil country tubular goods ("OCTG"). For purposes of this application, such steel pipes shall hereinafter be referred to as "tubular OCTG". Because of the length of the tubular OCTG required, individual sections of tubular OCTG are typically progressively added to the string as it is lowered into a well from a drilling rig or platform. The section to be added is restrained from falling into the well by some tubular engagement means, typically a spider or the like, and is lowered into the well to position the threaded pin of the tubular OCTG section adjacent the threaded box of the tubular OCTG in the well bore. The sections are then joined by relative rotation of the sections until such time as the desired total length has been achieved.

It is common practice to use a single joint elevator to transfer the tubular from the V-Door to a position above the rotary table whereby it can engage the tubular currently constrained in the rotary table. This traditional method and equipment types have been used extensively around the world for a period in excess of fifty years. While this method is in daily use it is a very dangerous task with personnel having to perform manual lifting and securing of the single joint elevator whilst it is tethered to a steel cable under high loads. The method of restraining the door or latch of the single joint elevator from opening under loads is a manually fitted mechanical pin. However this method relies solely on the operator to ensure the safety restraining pin is secured correctly. Because the single joint elevator can swing violently in rough or bad weather conditions it is not unusual for the safety restraining pin to be dislodged thereby placing the personnel on the rig floor under immense danger of possible falling objects or even a dropped tubular OCTG.

In more recent times, where a top drive may be used, this is a top drive rotational system used for drilling purposes. Where a top drive system is used to make the connection, the use of a set of hydraulically controlled bail arms have been employed to aid the positioning of the manual single joint elevator. However this can be problematic, due to the configuration of the top drive bails in so much as it protrudes or extends insufficient distance on the rig floor and it does not remove the manual intervention to secure the single joint elevator, safety restraining pin and thereby the safety hazard. It is therefore known to make use of an apparatus commonly referred to as a single joint elevator suspended from a steel wire cable or winch assembly used to transfer the tubular from the V-Door to the rotary table or mousehole.

The intention of the present invention is to offer a much-improved method for single joint elevator or tubular handling device for running tubular OCTG into a borehole without the shortfalls in the tools available today.

SUMMARY OF THE INVENTION

An apparatus has been invented for handling tubular OCTG. The apparatus is mountable to a set of link tilts or bail arms and can be used to secure the tubular OCTG from the outside. The system comprises an outer body, scissor plates, safety latch, mechanical safety interlock pins, and interchangeable die blocks, and one or more shock dampening cylinders. These cylinders may be mechanical, hydraulic or pneumatic or the like and are utilized to maintain a mostly perpendicular orientation between the "Tubular Handling Device" which shall hereinafter be referred to as "THD" and the link tilt or bail arms while allowing a given degree of freedom to rotate.

The operator can remotely manipulate the THD to extend or retract the hydraulic or pneumatic cylinder(s) causing a relative movement in the scissor plates and die blocks to secure the outer surface of the tubular OCTG on or around the drill floor. Once the operator has activated the hydraulic or pneumatic cylinder(s) thereby causing relative movement in the scissor plates and die blocks to secure the tubular OCTG, then it can be transferred, moved or positioned where required on the drill floor.

According to a first aspect of the present invention, there is provided a THD assembly for running tubular OCTG into and/or out of the well bore, the THD assembly comprising an outer body, scissor plates, one or more shock dampening cylinders which may be mechanical, hydraulic or pneumatic or the like are utilized to maintain a mostly perpendicular orientation between the THD and the link tilt or bail arms, safety latch, hydraulically or pneumatically activated mechanical safety interlock pins and interchangeable die blocks.

The THD further comprises one or more shock dampening cylinders or the like which are utilized to maintain a mostly perpendicular orientation between the THD and the link tilt or bail arms while allowing a given degree of freedom to rotate.

One major advantage of this method of engagement of the TUB is that it removes the need for manual handling of the large, heavy traditional single joint elevators and provides a means to manipulate, control and function the THD remotely greatly improving the safety aspects of the task.

According to a second aspect of the present invention, the THD assembly can facilitate the transfer of a tubular OCTG from the V-door of a drilling rig to the vertical position and thereby allowing the tubular OCTG to be stabbed into a similar tubular OCTG located in the slip assembly located in or on the drill floor for the running or pulling of tubular OCTG into and/or out of the well bore. The THD assembly may also have an elevator link tilt assembly comprising one or more hydraulic or pneumatic actuators, wherein the link tilt assembly is coupled to the telescoping transfer elevator link or bail arms such that the extension or retraction of the hydraulic or pneumatic actuators can pivot the telescoping transfer elevator links about a point located on a vertical axis; providing a secondary means of positioning the transfer elevators to facilitate transfer of the tubular OCTG into the stabbing position for make-up.

The THD assembly may further be provided with a positive locking means to maintain the scissor plate or plates and die blocks in engagement with a tubular OCTG should the make-up assembly otherwise fail. The positive locking means may comprise, for example, a spring, hydraulic or pneumatic safety interlock system and or a set of mechanical pins when fitted restrict the relative movement of the scissor plate or plates and or die blocks.

In addition to constraining, lifting and lowering the tubular OCTG, another aspect of the THD assembly is to function as a safety clamp or restraint for the tubular OCTG. In order to facilitate the restraint of tubulars when there is insufficient string weight the traditional method is to deploy a manual safety clamp. In use, the manual safety clamp has to be positioned by 2 or more personnel and is tightened against the tubular OCTG using manual wrenches and sledge hammers making this an extremely dangerous task. The THD however will be lifted into position using a winch, placed around the tubular OCTG, and an operator can remotely manipulate the THD to extend or retract the hydraulic or pneumatic cylinders causing a relative movement in the scissor plates and die blocks to securely grip the outer surface of the tubular OCTG on or around the drill floor.

The THD can also be configured to facilitate the correct thread engagement of a tubular OCTG wherein the THD is to be used as a tubular stabbing mechanism by attaching the THD assembly and associated components to a position in the derrick or rig structure at a suitable height above or below the rotary table raising the THD assembly to a position on the tubular to be latched or constrained.

The present invention further comprises a control system that is able to manipulate the telescoping transfer elevator links, link tilts, bail arms and other elements of all aspects of the present invention. The control system of the present invention is able to open and close the THD, retract and extend the telescoping transfer elevator links, the secondary link tilt, control and measure the application of torque and turns and stop the rotation of the make-up assembly of the present invention at a pre-determined torque point utilizing either a wireless communication system or a system of hydraulic or pneumatic and electrical control line umbilical. The wireless communication system can also be used in other applications to measure and control torque, applied loads and/or have the ability to dump torque or applied load a predetermined point. The system may also be coupled conventionally using a series of cables should the use of wireless communication be restricted.

The control system is also able to set and unset the hydraulic cylinders used to hydraulically manipulate the open and close aspects of the THD, the plane or tilt axis of the main body to facilitate varying angled V-Doors or tubular OCTG transfer systems to contact the tubular OCTG to facilitate handling of the tubular OCTG threaded connection. The control system is also able to monitor feedback loops that include sensors or monitors on the elements of the present invention. For example, sensors of the control system of the present invention monitor the open and close status of the THD and thereby the position of the scissor plate or plates. The control system is designed or rated for use in a hazardous working environment. Communication with the processor of the control system can be accomplished through a wireless communications link, these may include Zone 1 or Zone II certified components.

The THD may be further adapted to allow it to be as a tubular stabbing mechanism, the method comprising the steps of attaching the MD assembly and associated components to a position in the derrick or rig structure at a suitable height above or below the rotary table. The tubular OCTG can then be positioned manually or by the use of the THD and top drive assembly into a position whereby the THD can be used to constrain the tubular OCTG and through manipulation of hydraulic or pneumatic cylinders can move the tubular OCTG in a manner to aid engagement of the threaded section of the tubular. This use of the THD further removes personnel from the derrick structure thereby greatly enhancing safety.

The inventive THD assembly may also be connected to a power swivel suspended under a traditional Kelly in the event that the drilling rig does not have a top drive installed and/or on a hydraulic work-over rig or snubbing unit. In the latter application the power swivel may be installed into a hydraulic or pneumatically controlled frame to lift and lower the power swivel and thereby the THD of the present invention onto and off of the tubular OCTG.

It is an object of this invention that the make-up assembly further comprise an elevator assembly with elevator links and THD which can be remotely manipulated to extend or retract the THD to pick up and position a tubular OCTG above the tubular OCTG already secured in the rotary table on the drill floor wherein the operator can then engage the make-up assembly to and use the rotational capability of the top drive to remotely couple the two tubular OCTG together.

It is a further object of this invention that the elevator assembly comprise a set of links used to position the tubular OCTG from the horizontal position to the vertical position wherein said links each contain a single and/or multi stage hydraulic or pneumatic cylinder contained within the body of the links or mounted externally allowing the operator to extend the links into the correct position to accept the tubular OCTG in the THD.

It is a further object of the invention to provide a method of running tubular OCTG into and/or out of a well bore, comprising the steps of locating a tubular OCTG and extending links and THD around the tubular OCTG; moving a top drive assembly in an upward movement causing the captured or retained tubular OCTG into a vertical position above a tubular OCTG already secured in the rotary table on the drill floor; activation of the weight compensation system to lower the tubular OCTG in a controlled fashion into the aforementioned tubular OCTG already secured in the rotary table; engage the threads of the upper tubular OCTG in the threads of the tubular OCTG already secured in the rotary table on the drill floor; using either a top drive with attached make-up assembly tool to secure the tubular OCTG; once secured the rotational capability of the top drive or power tong can be functioned to cause the upper tubular OCTG threads to engage correctly with the opposing threads of the tubular OCTG already secured in the rotary table on the drill floor and thereby connecting both tubular OCTG into one continuous member; lifting the tubular OCTG members in an upward direction by the make-up assembly connected to the top drive while upsetting the slip mechanism of the retaining device in the rotary table to allow the joined tubular OCTG to be lowered into the well bore. By reversing the process the tubular OCTG members can be removed from a well bore if desired.

It is a further object of this invention to provide a tubular handling device with a body having a mostly "U" shaped profile which is shaped to accept an oilfield tubular into a throat area, two or more scissor plates configured between an upper and lower body plate, whereby each scissor plate rotates about a fixed axis and where each scissor plate may be supported via a bushing made of carbon steel, stainless steel, aluminum, bronze, brass, aluminum-bronze, fiber reinforced composite material, or a combination thereof, thrust plate (s) and each said scissor plate is hydraulically or pneumatically actuated to open and close around a tubular, die blocks which are constrained to each scissor plate which can be readily changed to accommodate a range of tubular outside diameters and or profiles, a safety latch mechanism which disallows the scissor plates to open once encompassing a tubular, a visual latch indicator which may be mounted to the THD, at a remote location or control console alerting the operator to the position of the safety latch. It may be electrical, mechanical, hydraulic or pneumatic, a hydraulic or pneumatically functioned visual latch indicator alerting the operator to the position of the safety latch, and wherein all functions of the THD can be operated remotely at a control console, wirelessly or via a touch screen. It is further intended that the THD can be used as a transfer elevator wherein one or more shock dampening cylinders or the like are utilized to maintain a mostly perpendicular orientation between the THD and the link tilt or bail arms while allowing a given degree of freedom to rotate, a safety clamp or a tubing stabbing mechanism wherein hydraulic or pneumatic cylinders are utilized in lieu of the shock dampening cylinders, thereby providing the operator precise control of the orientation of the THD in relation to the link tilt or bail arms.

It is a further object of this invention to provide a tubular handling device wherein a hole on the tip of each scissor plate overlaps one another thereby causing the holes to coincide, thus providing a means to use a mechanical pin or a hydraulically or pneumatically activated pin as a redundant safety device, and the safety interlock system controls the functions between the spider or flush mounted spider, elevator or casing make-up tool attached to the top drive, Kelly hook or a power swivel, link tilt or bail arms and the THD.

It is a further object of this invention to provide a tubular handling device with a body wherein the body utilizes a bolted and or welded construction and the body is manufactured utilizing standard machining practices and plate cutting techniques such as torch cutting, plasma cutting, laser cutting, and water-jet cutting thereby eliminating the need for castings.

It is a further object of this invention to provide a tubular handling device wherein a hole protrudes through the upper and lower plates or body of the THD and aligns with a hole in the scissor plate or plates thereby causing the holes to coincide, thus providing a means to use a mechanical pin or a hydraulically or pneumatically activated pin as a redundant safety device and wherein a hole protrudes through the upper and lower plates or body of the THD such that when the scissor plate or plates are in the fully closed position the holes coincide, thus providing a means to use a mechanical pin or a hydraulically or pneumatically activated pin as a redundant safety device.

It is a further object of this invention to provide a tubular handling device wherein the safety latch de-activation mechanism is hydraulically or pneumatically operated from a remote location but can also be mechanically overridden in case of hydraulic or pneumatic failure and wherein the interchangeable die blocks have a profile or load bearing shoulder matching that of the tubular to be hoisted or constrained.

It is a further object of this invention to provide a method for handling a tubular wherein the THD is to be used as an elevator, the method comprising the steps of, a) attaching the elevator assembly and associated components to the link tilt or bail arms, b) connecting the hydraulic or pneumatic lines to the control console, c) raising the link tilt or bail arms to a position above the tubular to be latched or constrained, d) de-activating the safety latch mechanism, e) opening the scissor plates to a fully open position, f) lowering the link tilt or bail arms to allow the tubular to enter the throat area of the THD, g) close the scissor plates to fully encompass the tubular, h) visually verify the safety latch mechanism is in the latched position, i) pickup on travelling block to position tubular into a vertical position, j) lower travelling block to allow tubular to engage tubular string, k) then reverse process as necessary.

It is a further object of this invention to provide a method for handling a tubular wherein the THD is to be used as an safety clamp, the method comprising the steps of, a) attaching the THD assembly and associated components to a fixed line or winch mechanism b) connecting the hydraulic or pneumatic lines to the control console, c) raising the THD assembly to a position on the tubular to be latched or constrained, d) de-activating the safety latch mechanism, e) opening the scissor plates to a fully open position, f) placing the THD assembly to allow the tubular to enter the throat area of the THD, g) close the scissor plates to fully encompass the tubular, h) visually verify the safety latch mechanism is in the latched position, i) then reverse process as necessary.

It is a further object of this invention to provide a method for handling a tubular wherein the THD is to be used as a tubular stabbing mechanism, the method comprising the steps of, a) attaching the THD assembly and associated components to a position in the derrick or rig structure at a suitable height above or below the rotary table b) connecting the hydraulic or pneumatic lines to the control console, c) raising the THD assembly to a position on the tubular to be latched or constrained, d) de-activating the safety latch mechanism, e) opening the scissor plates to a fully open position, f) placing the THD assembly to allow the tubular to enter the throat area of the THD, g) close the scissor plates to fully encompass the tubular, h) using hydraulic or pneumatic cylinders to move the THD in a linear fashion so as to aid engagement of the tubular member, threaded section or assembly i) then reverse process as necessary.

BRIEF DESCRIPTION OF THE DRAWINGS

These and other aspects of the present invention will now be described by way of example only and with reference to the accompanying drawings, in which.

DETAILED DESCRIPTION OF THE INVENTION

Figure 1:
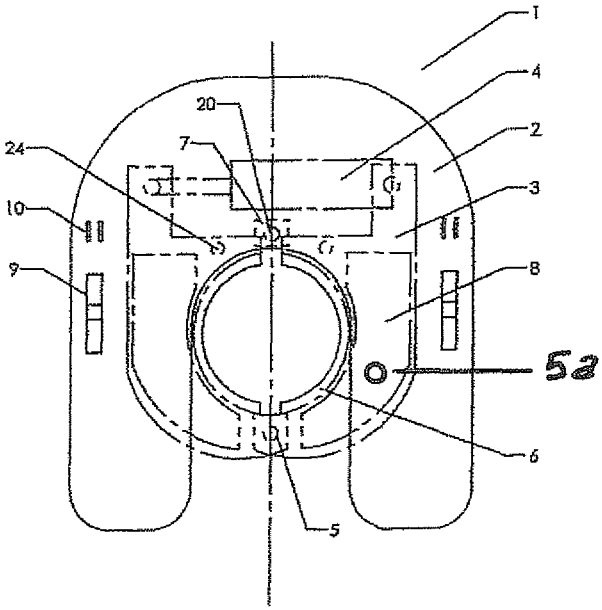
FIG. 1 is a top view of the THD.

FIG. 1 shows a top view of the tubular handling device (THD) 1 illustrating one embodiment utilizing two scissor plates 3. The two scissor plates rotate about an axis through hole 24. The scissor plates are centralized between the upper plate 11 and lower plate 12 via bushings 8. The housing 2 is fowled by the upper and lower plates as well as additional plates which make up the sides. Hydraulic or pneumatic cylinder 4 provides the force necessary to open and close the scissor plates about a tubular. Padeye 9 provides a means to connect the THD to the link tilts, bail arms, the stabbing mechanism system, cables, etc. depending upon the application it is to be used in. Padeyes 10 provide a means to connect the THD to the shock dampening cylinders when used as an elevator. Safety latch mechanism 20 provides a means to insure that the scissor plates do not open or release a tubular unintentionally in the case of hydraulic or pneumatic failure. An additional safety feature is the hole 5 located at the tip of each scissor plate which allows an operator to place a pin through both scissor plates, thereby eliminating the possibility of opening prematurely or unintentionally. A visual latch indicator 7 is mounted atop or near the safety latch mechanism to provide a visual indication as to the position of the latch. The mechanical model of this component provides a red indication for an unlatched position and a green indication for a successful latch situation. This mechanical indicator may be replaced or used in conjunction with electrical, hydraulic, or pneumatic sensors or devices to send a signal to a remote control console such that a visual and or audible indication is provided to the operator. Die blocks 6 are held in place via die retainers (not shown for clarity) onto the scissor plates.

Figure 2:
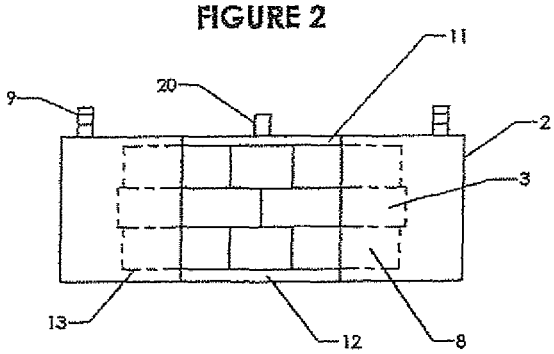
FIG. 2 is an end view of the THD.

FIG. 2 is an end view of the THD illustrating the position of the scissor plates 3 and bushing plates 8 within the housing 2.

Hole 5*a* protrudes through upper plate 11, lower plate 12 and scissor plate 3 to provide a means to use a mechanical pin or a hydraulically or pneumatically activated pin as a redundant safety device.

Figure 3:
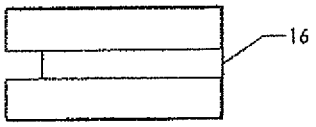
FIG. 3 is an end view of one embodiment of a die retainer.
Figure 4:
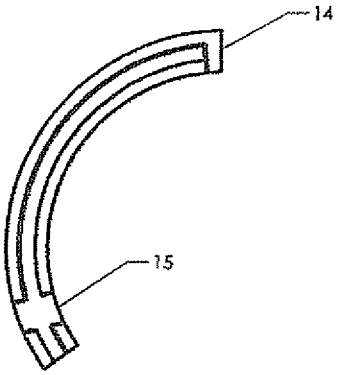
FIG. 4 is a top view of the die retainer.
Figure 5:
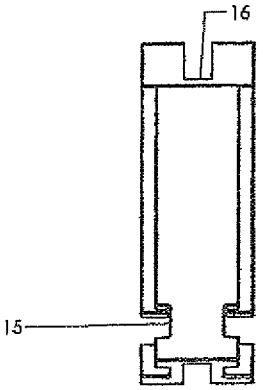
FIG. 5 is a side view of the die retainer.
Figure 6:
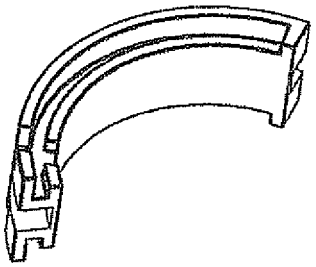
FIG. 6 is an angled view of the die retainer.
Figure 7:
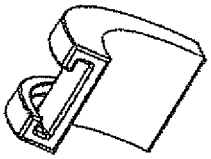
FIG. 7 is an angled view of one embodiment of the die block.
Figure 9:
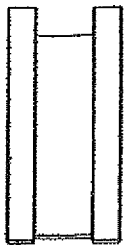
FIG. 9 is a left side view of the die block.
Figure 8:
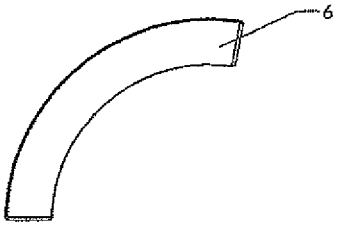
FIG. 8 is a top view of the die block.
Figure 10:
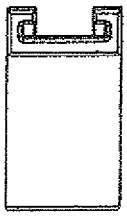
FIG. 10 is a right side view of the die block.

FIG. 3 through FIG. 5 illustrates one embodiment of the die retainer 14. FIG. 3 illustrates the slot 16 which positions the die retainer in the correct orientation onto the scissor plates prior to welding. FIG. 4 shows a slot 15 through which a die retainer clip 17 is inserted which holds a die onto a die retainer. FIG. 5 simply shows the slots 15 and 16 from a different orientation. FIG. 6 is an angled view of the die retainer.

FIG. 7 through FIG. 10 illustrate one embodiment of the die 6. It is apparent from the profiles of the die and die retainers, that the dies are designed to slide onto the die retainers whereby they are constrained via the die retainer clip 17. This can be seen in more detail in FIGS. 14-16.

Figure 11:
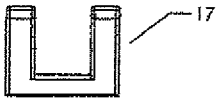
FIG. 11 is front view of one embodiment of the die retainer clip.
Figure 13:
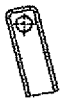
FIG. 13 is a side view of the die retainer clip.
Figure 12:
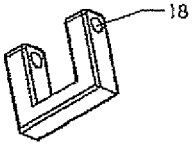
FIG. 12 is an angled view of the die retainer clip.

FIG. 11 through FIG. 13 show various orientations of the die retainer clip. Also shown is hole 18, through which a pin is placed to keep the die retainer clip affixed to the die retainer.

Figure 14:
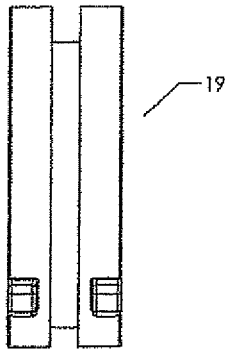
FIG. 14 is a side view of the die, die retainer, and die retainer clip assembly.
Figure 15:
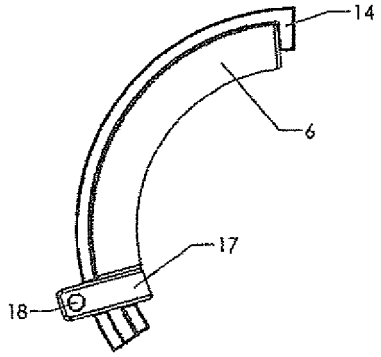
FIG. 15 is a top view of the die, die retainer, and die retainer clip assembly.
Figure 16:
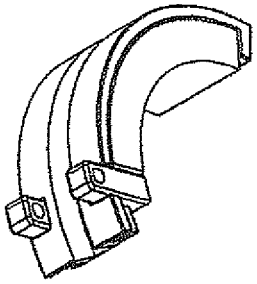
FIG. 16 is an angled view of the die, die retainer, and die retainer clip assembly.

FIG. 14 through FIG. 16 show various views of the entire die and die retainer assembly. It is apparent from these figures the ease of changing out the dies.

Figure 17:
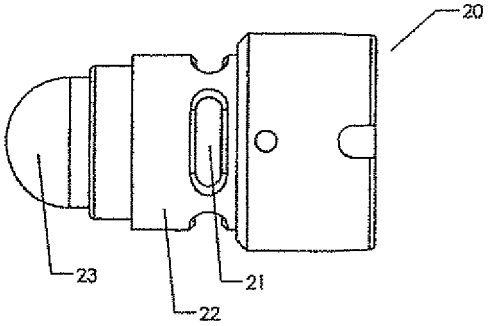
FIG. 17 is a front view of one embodiment of the mechanical visual latch indicator assembly.
Figure 18:
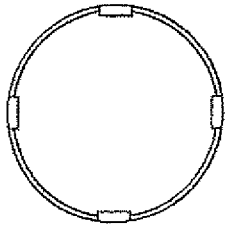
FIG. 18 is a top view of the mechanical visual latch indicator assembly.

FIG. 17 and FIG. 18 illustrate one embodiment of the mechanical visual latch indicator 20. The indicator is provided with several sight windows in body 22 through which a red or green indication is visible to the operator at area 21. The indicator is activated by motion from the indicator dart 23. This dart is spring loaded (not shown for clarity) to make certain that it is always in contact with the latch mechanism 7. The spring also assist to keeping the latch in a latched position, as a redundant spring.

Figure 19:
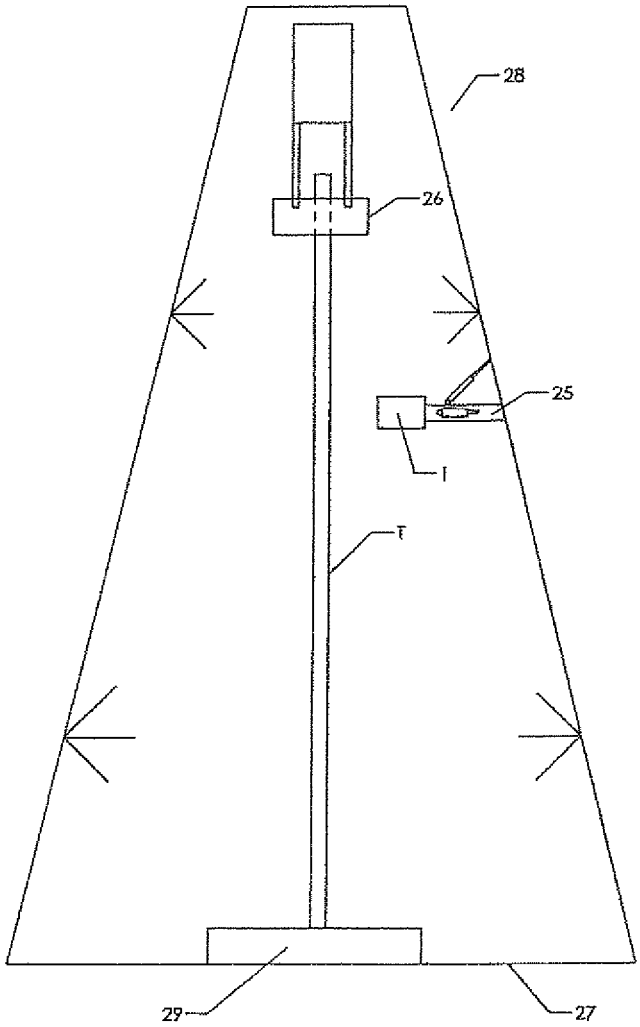
FIG. 19 is an elevation view of a drilling rig derrick structure illustrating one embodiment and location of the THD being utilized as a tubular stabbing mechanism.

FIG. 19 shows a drilling or workover rig 28 whereby the THD 1 is being utilized in the derrick structure as a tubular stabbing mechanism. It is attached to the derrick structure via a system of steel members and hydraulic or pneumatic cylinders. This system allows an operator, working remotely in a safe location, to position the THD to latch onto a mostly upper portion of a tubular T and assist in guiding the tabular to a vertical and aligned position with tubular already positioned in the rig floor 27, generally through a spider 29. This provides a means for the tubulars to be in precise alignment such that their threads engage properly. This removes the need for personnel to be working at elevated heights above the rig floor in dangerous conditions. The tubulars T are typically raised or lowered using some form of elevator 26.

Figure 20:
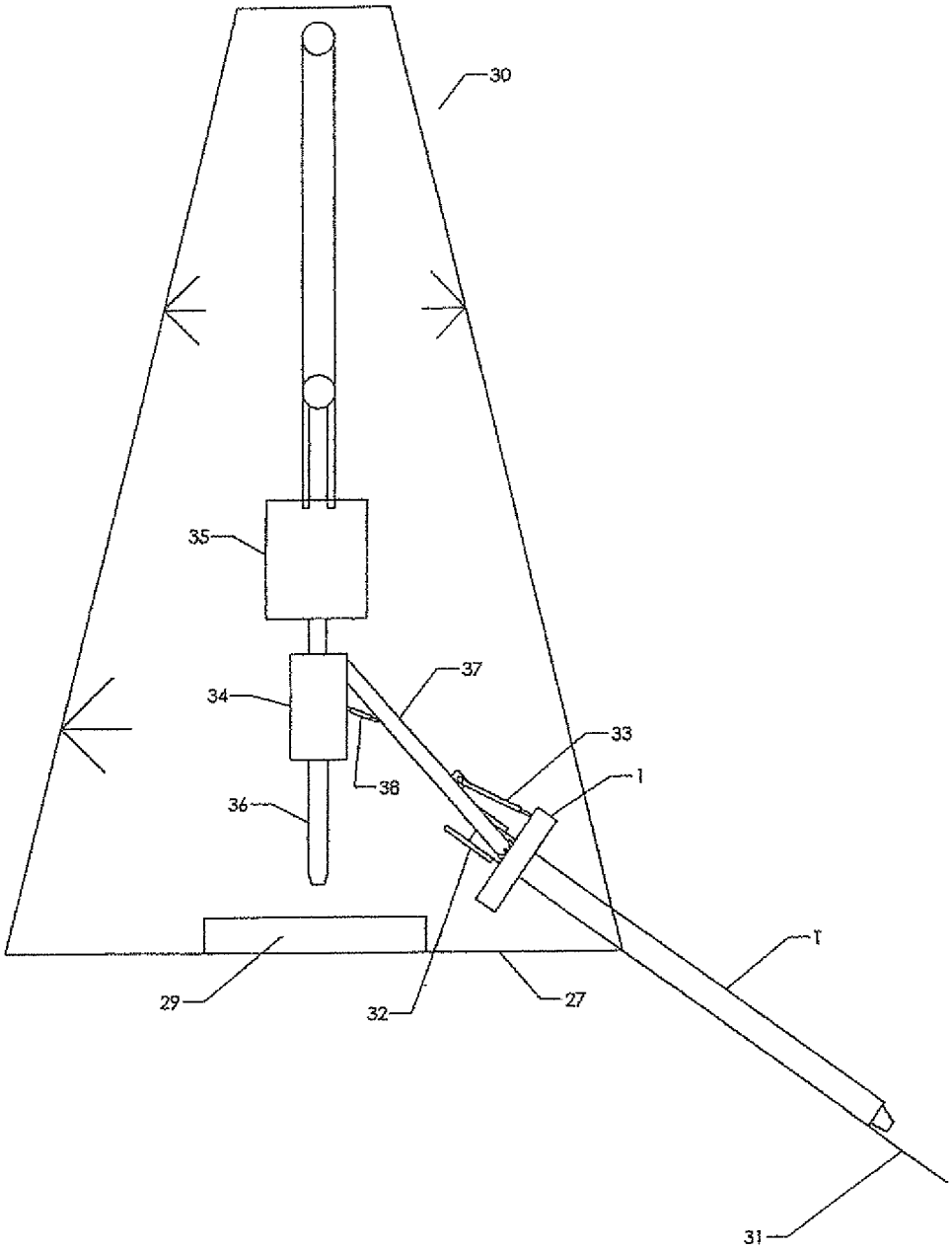
FIG. 20 is an elevation view of a drilling rig derrick structure illustrating one embodiment of the THD being utilized as an elevator in conjunction with a top drive tubular running application. It should be noted that manufacturers of top drive systems are many and each may have their own technical differences in configuration of moving parts. However, it is generally found that they are all capable of executing the same tasks of providing a means for connection to a drilling string or cross-over sub; providing a means for rotation in both forward and reverse directions and the ability to apply torque in varying degrees of power.

FIG. 20 shows a drilling or workover rig 28 whereby the THD 1 is being utilized as an elevator to latch onto tubular T from the V-door 31 to allow the tubular to be raised to a vertical position. These tubulars often have some form of coupling 32 on one end which can be used to aid in lifting operations. In this application, the THD is attached to link arms 37 which can be manipulated to pivot via hydraulic or pneumatic cylinders 38. The shock dampening cylinders 33 keep the THD in a mostly perpendicular position in relation to the link tilts while providing a degree of flexibility. As the THD latches onto the tubular, it must be allowed to become perpendicular with the tubular for proper engagement. Thus the THD will not be always be exactly perpendicular to the link tilts for brief periods of time surrounding the actual latching. As the tubular is being lifted, the shock dampening cylinders will urge the THD back to its original perpendicular orientation. Also shown in this figure are the top drive 35, top drive tubular running tool 34, and a top drive lifting apparatus 36 which are common to this type of application.

It will be apparent that many other changes may be made to the illustrative embodiments, while falling within the scope of the invention and it is intended that all such changes can be covered by the claims appended hereto.

Although the disclosed embodiments have been described in detail, it should be understood that various changes, substitutions and alterations can be made to the embodiments without departing from their spirit and scope. Other technical advantages of the present invention will be readily apparent to one skilled in the art from the following figures, drawings, descriptions and claims.

What is claimed is:

1. A tubular handling device comprising:

a body having a mostly "U" shaped profile which is shaped to accept an oilfield tubular into a throat area;

two or more scissor plates with overlapping tips, each tip configured for disallowing the scissor plates to open once encompassing a tubular, configured between an upper and lower body plate, whereby each scissor plate rotates about a fixed axis and where each scissor plate is supported by bushings and each said scissor plate is hydraulically or pneumatically actuated to open and close around a tubular;

a die retainer secured to each scissor plate;

a die block secured to each die retainer, wherein each die block is configured to be readily replaced to accommodate a range of tubular outside diameters or profiles;

a die retainer clip inserted through a transverse slot of the die retainer to secure the die block to the die retainer; and a control console for remote operation of all functions of the tubular handling device.

2. The tubular handling device of claim 1 wherein the bushings are made of: carbon steel, stainless steel, aluminum, bronze, brass, aluminum-bronze, fiber reinforced composite material, or a combination thereof.

3. The tubular handling device of claim 1 wherein the tubular handling device is configured to be used as a transfer elevator and link arms are attached to the tubular handling device.

4. The tubular handling device of claim 3, wherein one or more shock dampening cylinders are connected between the tubular handling device and the link arms and configured to maintain a mostly perpendicular orientation between the tubular handling device and the link arms while allowing a given degree of freedom to rotate.

5. The tubular handling device of claim 1 wherein the tubular handling device is configured to be used as a safety clamp.

6. The tubular handling device of claim 1 wherein the tubular handling device is configured to be used as a tubular stabbing mechanism.

7. The tubular handling device of claim 6 wherein hydraulic or pneumatic cylinders are utilized, thereby providing the operator precise control of the orientation of the tubular handling device in relation to the link arms.

8. The tubular handling device of claim 1 whereby the function between the tubular handling device and a spider or flush mounted spider, an elevator or casing make-up tool attached to the top drive, Kelly hook or a power swivel, link arms are controlled by a safety interlock system.

9. The tubular handling device of claim 1 wherein the body utilizes a bolted or welded construction.

10. The tubular handling device of claim 1, wherein the body is manufactured utilizing standard machining practices and plate cutting techniques comprising torch cutting, plasma cutting, laser cutting, and water-jet cutting thereby eliminating the need for castings.

11. The tubular handling device of claim 1 wherein a hole protrudes through the upper and lower plates or body of the tubular handling device and aligns with a hole in the tips of the scissor plates thereby causing the holes to coincide, allowing for placement of a mechanical pin disallowing the scissor plates to open once encompassing a tubular.

12. The tubular handling device of claim 1 wherein the die blocks have a profile or load bearing shoulder matching that of the tubular to be hoisted or constrained.

13. The tubular handling device of claim 1, further comprising a latch mechanism located proximate to and between rotating axes of each of the scissor plates, wherein the latch mechanism is configured to disallow the scissor plates from opening once encompassing the tubular.

14. The tubular handling device of claim 13, further comprising a visual latch indicator configured to provide an indication as to a position of the latch mechanism.

15. The tubular handling device of claim 1, each tip further comprising a hole coinciding with a hole in the other tip for optional placement of a mechanical pin for disallowing the scissor plates to open once encompassing a tubular.

16. A drilling or workover rig comprising:

a tubular handling device comprising:

a body having a profile configured to accept an oilfield tubular into a throat area;

two opposed scissor plates each configured to rotate about a fixed axis, wherein each scissor plate is supported by bushings and each said scissor plate is hydraulically or pneumatically actuated to open and close around the oilfield tubular;

a die retainer secured to each scissor plate a die block secured to each die retainer, wherein each die block is configured to be readily replaced to accommodate a range of tubular outside diameters or profiles; and one or more link arms attached to the tubular handling device and configured to be manipulated to pivot via cylinders;

one or more shock dampening cylinders connected between the tubular handling device and the one or more link arms, wherein the shock dampening cylinders are configured to maintain the tubular handling device in a substantially perpendicular position relative to the link arms, wherein the tubular handling device is operable from a control console for remote operation of all functions wirelessly or via touch screen to latch onto a tubular and raise the tubular to a substantially vertical position.

17. A method of handling a tubular using a tubular handling device in an automated manner, the device comprising a body having a profile configured to accept the tubular into a throat area, two opposed scissor plates configured to rotate about a fixed axis, a die retainer secured to each scissor plate, and a die block secured to each die retainer, the method comprising:

attaching the tubular handling device to one or more link arms;

attaching shock dampening cylinders between the tubular handling device and the link arms;

selecting die blocks configured or sized to accommodate the tubular diameter or profile;

operating the tubular handling device from a control console, and latching onto a tubular with scissor arms of the tubular handling device, and raising the tubular to a substantially vertical position; and maintaining a substantially perpendicular orientation between the tubular handling device and the link arms while allowing a given degree of freedom to rotate.

* * * * *